US008480060B2

(12) United States Patent
Lee

(10) Patent No.: US 8,480,060 B2
(45) Date of Patent: Jul. 9, 2013

(54) CRANE CABLE ROLLER ASSEMBLY

(75) Inventor: Gregory Clifford Lee, Valley Center, CA (US)

(73) Assignee: T.B. Penick & Sons, Inc., San Diego, CA (US)

( * ) Notice: Subject to any disclaimer, the term of this patent is extended or adjusted under 35 U.S.C. 154(b) by 743 days.

(21) Appl. No.: 12/688,502

(22) Filed: Jan. 15, 2010

(65) Prior Publication Data

US 2011/0176902 A1 Jul. 21, 2011

(51) Int. Cl.
*B66D 3/04* (2006.01)

(52) U.S. Cl.
USPC ..... 254/390; 254/408

(58) Field of Classification Search
USPC ..... 254/390, 408
See application file for complete search history.

(56) References Cited

U.S. PATENT DOCUMENTS

| | | | | |
|---|---|---|---|---|
| 3,701,258 | A * | 10/1972 | Rhodes | 405/63 |
| 4,423,853 | A * | 1/1984 | Davis, Sr. | 254/390 |
| 4,541,615 | A * | 9/1985 | King, Jr. | 254/134.3 FT |
| 5,967,496 | A * | 10/1999 | Ulrich et al. | 254/326 |
| 6,176,463 | B1 | 1/2001 | Rock | |
| 6,877,720 | B1 * | 4/2005 | Dublin, Jr. | 254/390 |
| 6,908,074 | B2 * | 6/2005 | Eiwan | 254/390 |
| 7,357,224 | B2 * | 4/2008 | Halevy | 182/233 |
| 7,395,899 | B2 * | 7/2008 | May | 182/142 |
| 7,631,854 | B1 * | 12/2009 | Mountain | 254/390 |
| 2005/0098383 | A1 * | 5/2005 | Halevy | 182/233 |
| 2009/0272604 | A1 | 11/2009 | Holawe | |

FOREIGN PATENT DOCUMENTS

WO WO9316253 8/1993

OTHER PUBLICATIONS

Patent Construction Systems; "Aluminum Flying Form System"; 8 pages.
Guagdong Yeehuaxing Construction Machinery Co., "Preston-YHX Superdeck"; Nov. 17, 2009; 1 page.
www.wikipedia.org; Formwork & Concrete Form Types; Dec. 15, 2009; 6 pages.
Atlas Sales Company; "The Flying Form Construction System"; Dec. 15, 2009; 5 pages.
Preston Performance Through Innovation; "SuperDeck Time and Cost Comparison"; 2 pages.
Formwork News; "Doka Formwork Solutions—The Key to Success"; Jan. 2007; 8 pages.
American Concrete Institute; "The Contractor's Guide to Quality Concrete Construction"; 30 pages.

* cited by examiner

*Primary Examiner* — Emmanuel M Marcelo
(74) *Attorney, Agent, or Firm* — Stetina Brunda Garred & Brucker

(57) ABSTRACT

A crane cable roller assembly is disclosed. The assembly may be attached to an anchoring structure above an existing lower floor. When objects are located interiorly on the existing lower floor, a cable of a crane can be lowered and laid against a roller of the assembly and attached to the object. Lifting of the cable vertically also pulls the object toward the outer peripheral area and toward the edge of the floor so that the cable of the crane can be attached to the object and be vertically lifted to reposition the object as desired.

11 Claims, 5 Drawing Sheets

CRANE CABLE ROLLER ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a method and device for pulling a load from an interior area of a floor toward an outer peripheral area of the floor of a multi-story building wherein the load can then be vertically lifted by crane to transport the load to a different location as desired.

Floors of a multistory building may be fabricated by various methods. One method is to transport a concrete floor form to a floor. The concrete floor form is then raised to the appropriate level and concrete is poured on the concrete floor form to form the floor immediately above (i.e., upper floor). After the concrete is cured, the concrete floor form is lowered and extracted from between the lower floor and the newly created upper floor. The concrete floor form is traversed to the edge of the lower floor, hoisted up by a crane and transported to the newly created upper floor. The process is then repeated for each upper floor.

In order to traverse the concrete floor form from the interior area to the edge of the lower floor, construction workers must manually maneuver the concrete floor to the edge of the lower floor. This manual process is time consuming which increase the cost of the project since the crane must idly wait for the construction workers to properly position the concrete floor form.

Accordingly, there is a need in the art for more conveniently and efficiently moving an object on a floor of a multi-story building.

BRIEF SUMMARY

The crane cable roller assembly described herein addresses the needs discussed above, discussed below and those that are known in the art. The crane cable roller assembly may be attached to an upper cross beam located at the outer periphery of a building for moving objects laterally on a lower floor by assistance with a crane. More particularly, the crane cable roller assembly may be attached to a cross beam directly above a lower floor. An object such as a concrete floor form, palette or other object may be disposed at an interior area of the lower floor. The crane cable roller assembly is discussed in relation to a concrete floor form. However, it is contemplated that the crane cable roller assembly may be used in relation to any object such as a palette, cabinet, motor, heavy machinery, etc. for moving the object laterally on the lower floor. A cable of the crane may be positioned directly in front of the crane cable roller assembly so that the cable hangs vertically directly in front of the crane cable roller assembly. A construction worker may grab the distal end of the cable of the crane and attach the distal end of the crane cable to the object. At this point, the crane cable may rest on the crane cable roller assembly and be attached to the object. When the cable is lifted vertically upward, the cable pushes against a roller of the crane cable roller assembly. As the cable is continued to be lifted upward, the roller behaves as a pulley.

The crane cable roller assembly converts the vertical motion of the cable into a horizontal component to drag the object laterally on the lower floor until the object reaches the outer peripheral area. Accordingly, the crane cable roller assembly provides a means for more efficiently moving objects located at an interior area of the lower floor to the outer peripheral area of the lower floor. Once the object is located or traversed to the outer peripheral area of the lower floor, the cable of the crane may be reattached to the object from above so that the crane can lift then move the object to a different location as desired.

More particularly, an unfinished multi-story building is disclosed. The multi story building may comprise upper and lower floors and a crane cable roller assembly. The upper floor may define a lower edge, a lower surface, an upper edge and an outer periphery. The lower floor may define an interior area and an outer peripheral area. The crane cable roller assembly may be attached to the outer periphery of the upper floor for guiding a cable of a crane as the crane cable pulls an object (e.g., concrete floor form, etc.) located at the interior area of the lower floor to the outer peripheral area of the lower floor.

A roller of the crane cable roller assembly may be disposed closer to the lower edge than the upper edge of the upper floor. The rotating axis of the roller may be horizontally aligned to the lower edge of the upper floor. Also, the rotating axis of the roller may be generally parallel to the outer periphery of the upper floor. The roller may be horizontally offset away from the outer periphery of the upper floor. A lower side of the roller may be at a lower elevation compared to the lower surface of the upper floor. Alternatively, the lower side of the roller may be slightly above a lower surface of the upper floor so long as the cable of the crane does not inadvertently contact the lower surface of the upper floor as the object is pulled toward the outer peripheral area of the lower floor.

The crane cable roller assembly may further comprise side guides attached to opposed end portions of the roller for guiding the cable of the crane on the roller. A distance between a respective pair of side guide and end portion of the roller may be less than a radius of the cable of the crane to prevent wedging of the cable between the roller and the side guide.

A method of pulling an object from an interior area of a lower floor to an outer peripheral area of the lower floor of an unfinished multi story building is disclosed. The method may comprise the steps of attaching a crane cable roller assembly to an outer periphery of an upper floor; attaching a distal end portion of a cable of a crane to the object located at the interior area of the lower floor; aligning the cable to a roller of the crane cable roller assembly; vertically lifting the cable of the crane; urging the cable against the roller of the crane cable roller assembly; and converting the vertical lift of the cable of the crane into a horizontal pull component to pull the object located at the interior area of the lower floor to the outer peripheral area of the lower floor.

The attaching the crane cable roller assembly step may comprise the steps of aligning a roller of the crane cable roller assembly to a lower edge of the upper floor and mounting the crane cable roller assembly to the outer periphery of the upper floor.

The method may further comprise the step of moving the cable of the crane in front of the roller of the crane cable roller assembly. The method may also further comprise the step of continuing to lift the cable of the crane until the object is traversed to the outer peripheral area. The method may further comprise the step of guiding the cable of the crane between side guides to maintain the cable of the crane on the roller during the lifting step.

A crane cable roller assembly is also disclosed. The assembly converts the vertical lift of a cable of a crane into a horizontal component to pull an object located between upper and lower floors from an interior area of the lower floor to an outer peripheral area of the lower floor. The crane cable roller assembly may comprise a roller, a pair of side guides and a backplate. The roller may receive the cable of the crane. The pair of side guides maintain the cable of the crane on the roller as the cable is lifted to pull the object from the interior area of the lower floor to the outer peripheral area of the lower floor. The pair of side guides may be mounted to opposed end portions of the roller. The backplate permits mounting of the crane cable roller assembly to the upper floor. The back plate may be attached to the side guides.

The roller may generally be parallel with the backplate. The back plate may have a plurality of apertures for receiving a concrete bolt for bolting the assembly to the upper floor. A gap between distal end portions of the roller and the side guides is less than a radius of the cable of the crane.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 2:
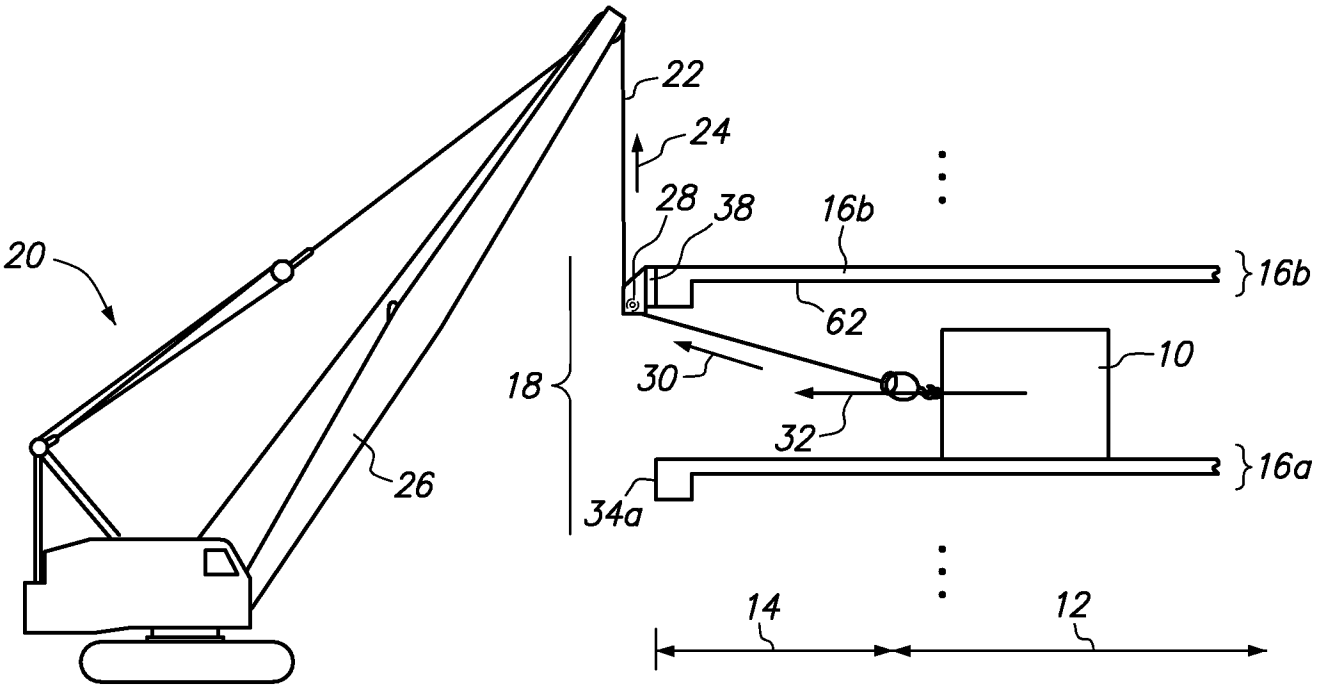
FIG. 2 is a cross sectional view of the multistory building shown in FIG. 1 illustrating a crane cable roller assembly for pulling an object disposed on a lower floor.

Referring now to FIG. 2, a method and device for horizontally pulling an object (e.g., concrete floor form, pallet, etc.) 10 from an interior area 12 toward an outer peripheral area 14 of a floor 16*a* of a multistory building 18 is disclosed. The method and device is discussed in relation to a concrete floor form for the purposes of illustration and not limitation. The method and device discussed herein may be employed in relation to other types of objects such as equipment, furniture, pallet(s), machinery, raw material (e.g., I beam, wood, etc.), and the like. A crane 20 having a cable 22 may be pulled vertically upward as shown by directional arrow 24. The cable 22 is attached to the object 10. The cable 22 hangs straight down from a distal end of a boom 26 of the crane 20 due to gravitational forces. The cable 22 may be guided by hand toward the interior area 12 and attached to the object 10. As can be seen, the cable 22 is bent and rests upon a roller 28. As the cable 22 is lifted upward in the direction of arrow 24, the cable 22 below the roller 28 is pulled in direction of arrow 30. Arrow 30 has a vertical and horizontal component. The horizontal component pulls the object 10 in the direction of arrow 32 horizontally across the floor 16*a* toward the outer peripheral area 14 of the floor 16*a*. Once the object 10 is sufficiently close to the edge surface 34*a* of floor 16*a*, the cable 22 may be reattached to the object 10 such that the crane can vertically lift and transport the object 10 to a different location (e.g., new upper floor). For example, the cable 22 may be attached to the object 10 with respect to its center of gravity. The cable 22 may be pulled upward and may lift the object 10 off of the floor 16*a*. The crane 20 may manipulate the boom 26 to move the object 10 away from the building 18 and to a different location (e.g., upper floor) as desired. The roller 28 provides a means of converting the vertical lift of the cable 22 into a horizontal component to conveniently and easily traverse the object 10 from the interior area 12 of the floor 16*a* toward the outer peripheral area 14.

Figure 1:
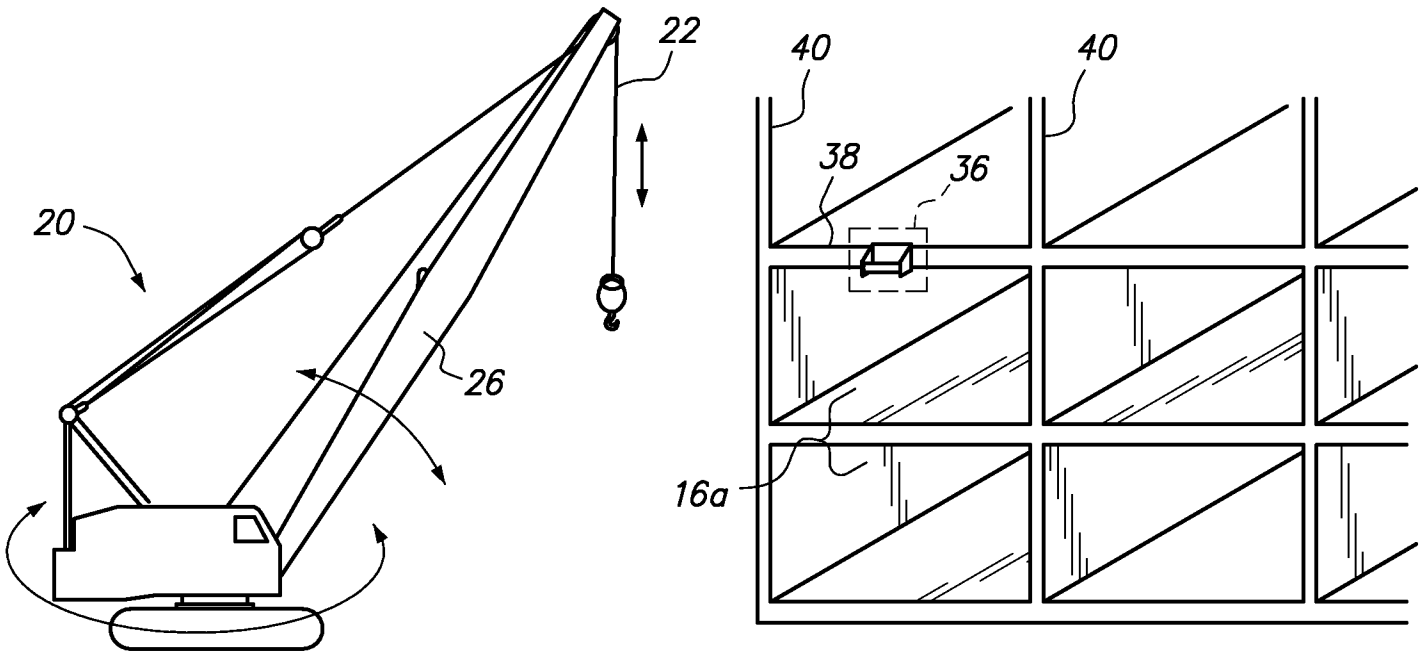
FIG. 1 is a perspective view of a job site of a multistory building.
Figure 3:
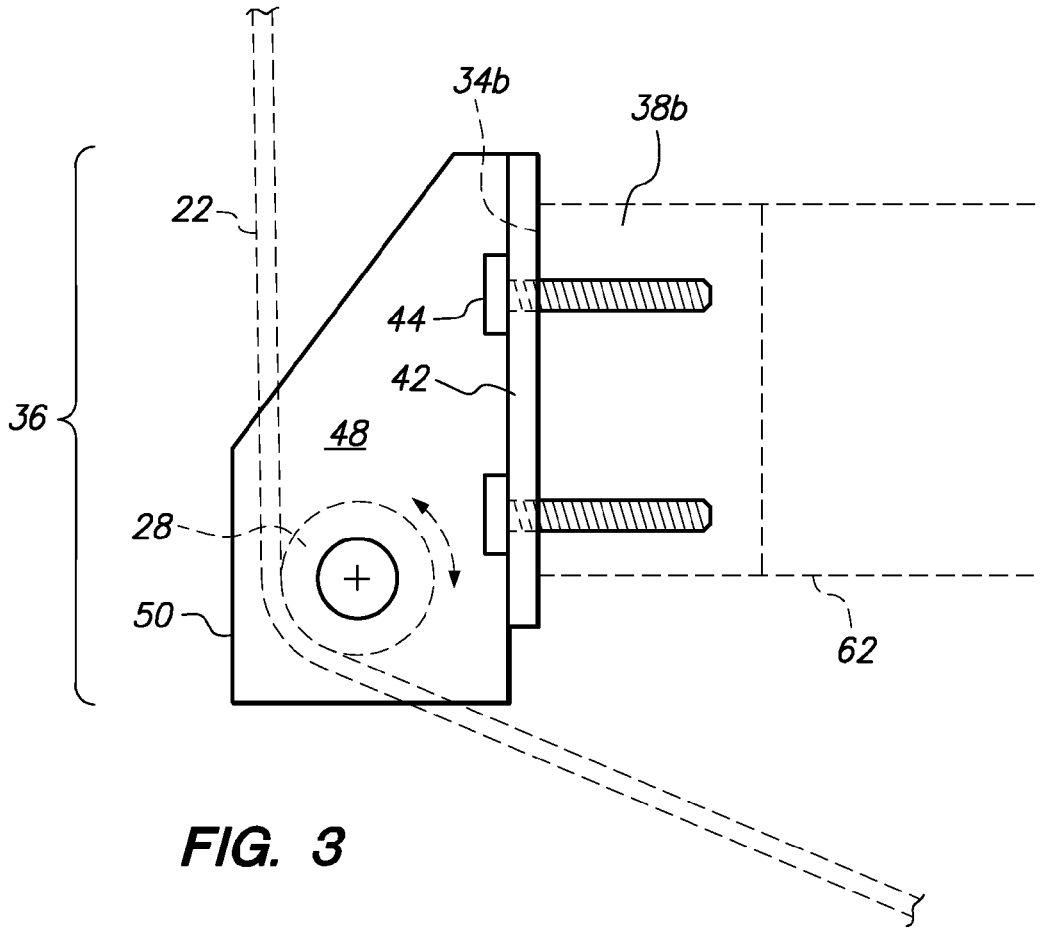
FIG. 3 is an enlarged view of the crane cable roller assembly shown in FIG. 2.
Figure 4:
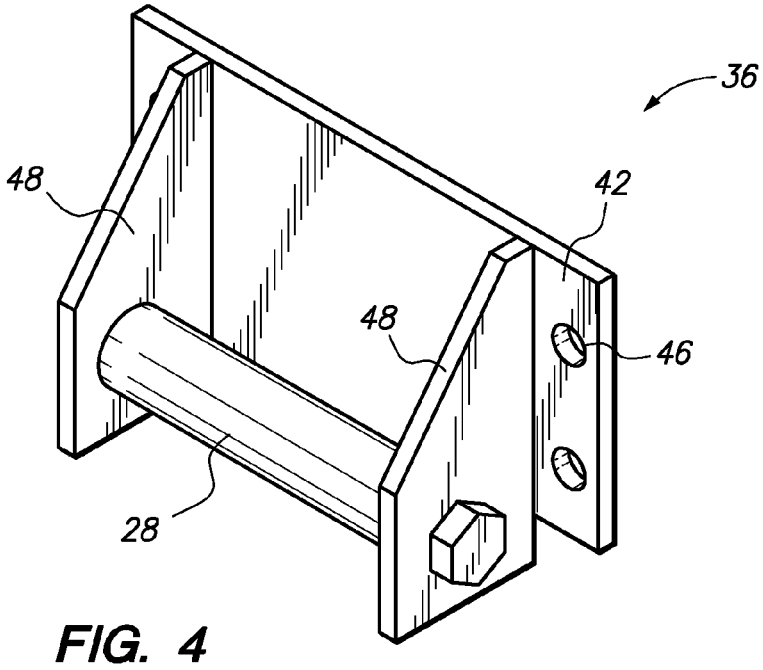
FIG. 4 is a perspective view of the crane cable roller assembly shown in FIG. 3.

More particularly, the roller 28 may be a component of a crane cable roller assembly 36, as shown in FIG. 3. The crane cable roller assembly 36 may be attached to an edge surface 34*b* of an anchoring structure 38*b* immediately above the floor 16*a*. The anchoring structure 38 may be a crossbeam, I-beam, etc. that extends between columns 40, as shown in FIG. 1. The crane cable roller assembly 36 may comprise a back plate 42 which may be attached to the anchoring structure 38 by way of anchoring bolts 44 (see FIG. 3). The back plate 42 may have two apertures 46 (see FIG. 4) on opposed sides of the back plate 42 to attach the crane cable roller assembly 36 to the anchoring structure 38. The back plate 42 may withstand any forces that may be imposed upon the crane cable roller assembly 36 by the cable 22 of the crane 20. Guide plates 48 may extend perpendicularly from the back plate 42 and be sufficiently gaped apart from each other to receive the cable 22 therebetween. The roller 28 is rotatably mounted between the guide plates 48 and may be generally parallel with the anchoring structure 38 such that the cable 22 does not drift off of the roller 28 while pulling the object 10 across the floor 16*a*.

Figure 5:
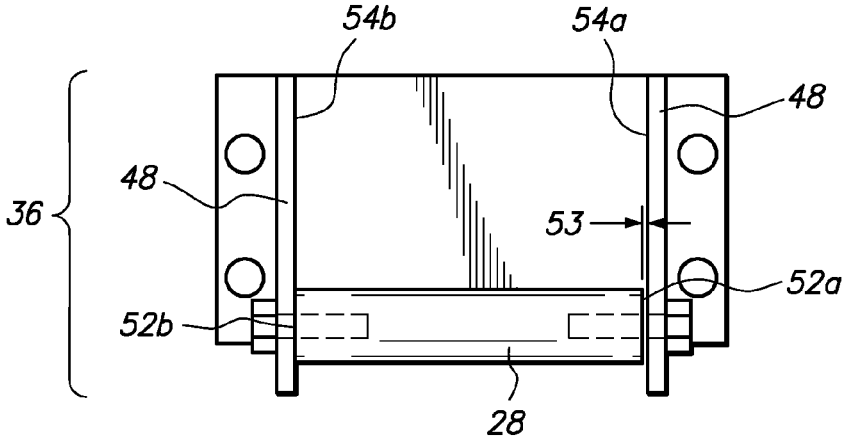
FIG. 5 is a front view of the crane cable roller assembly shown in FIG. 4.
Figure 6:
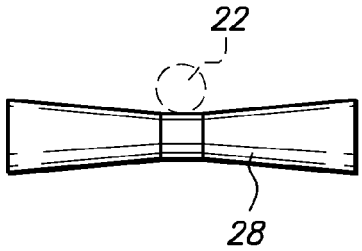
FIG. 6 is an alternate embodiment of the roller shown in FIG. 5.

Referring back to FIG. 3, an exterior edge surface 50 of the guide plates 48 may extend beyond the outer diameter of the roller 28. In this manner, as the cable 22 is shifted left to right on the roller 28, the guide plates 48 maintain the cable 22 on the outer surface of the roller 28 and between the guide plates 48. Referring now to FIG. 5, the roller 28 may be disposed closely adjacent the guide plates 48. In particular, the distal ends 52*a, b* may be closely adjacent medial sides 54*a, b* of the guide plates 48*a, b*. By way of example and not limitation, when the roller 28 is shifted to one side (e.g., the left side as shown in FIG. 5), there may be a small gap 53 between the distal end 52*a* and the medial side 54*a* of the guide plate 48*a*. This small gap 53 may be less than a radius of the cable 22 so that the cable 22 does not become wedged between the distal end 52*a* and medial side 54*a* of the guide plate 48*a*. The same may be true when the roller 28 is shifted to the right. The roller 28 may have an exterior surface that is generally cylindrical across its entire length as shown in FIG. 5. However, other configurations are also contemplated as shown in FIG. 6. In particular, the roller 28 may have a generally concave configuration such that the cable 22 will generally track toward the middle of the roller 28.

Figure 7:
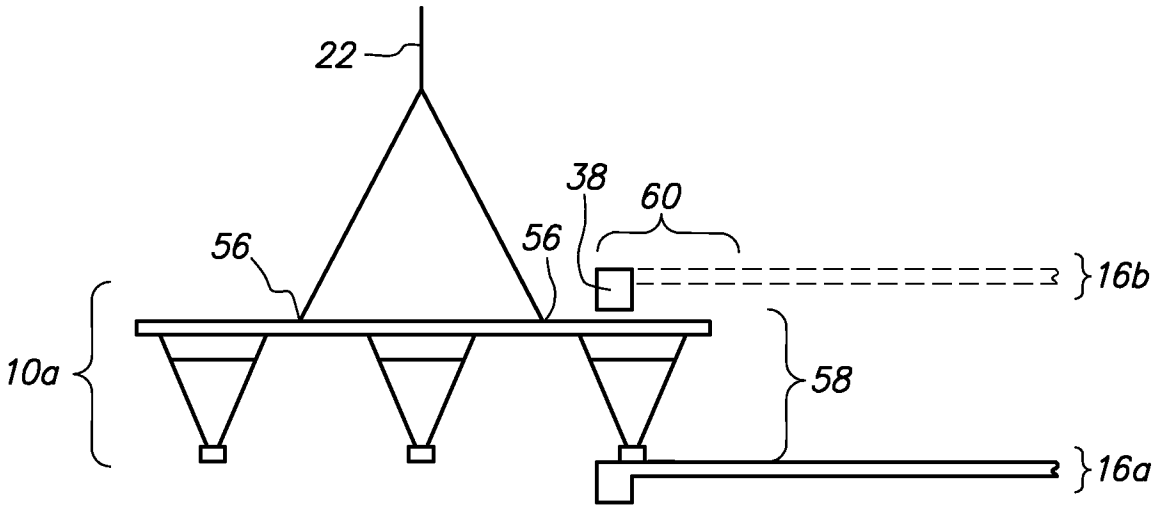
FIG. 7 is a cross sectional view of the building illustrating loading of a concrete floor form on a floor by way of a crane cable.

The operation of the crane cable roller assembly 36 will be discussed in relation to a concrete floor form 10*a* that is used to form an upper floor then transferred to that upper floor to then form the next upper floor of the building 18. The concrete floor form 10*a* is discussed in relation to the crane cable roller assembly 36 for the purpose of illustration and not limitation. By way of example and not limitation, the crane cable roller assembly 36 may be employed with other types of objects such as equipment, furniture, pallet(s), machinery, raw material (e.g., I beam, wood, etc.), and the like. During construction of the building 18, the concrete floor form 10*a* is hoisted up off of the ground by crane 20, as shown in FIG. 7. The cable 22 may be connected at two points to the concrete floor form 10*a*. By way of example and not limitation, the two points of connection 56 may be one-third (⅓) in from distal ends of the concrete floor form 10*a* centered above its center of gravity, as shown in FIG. 7. The concrete floor form 10*a* is brought to the elevation of an opening 58 defined by anchoring structure 38 and the floor 16*a*. The crane 20 moves the concrete floor form 10*a* through the opening 58 and gently rests the distal end portion 60 of the concrete floor form 10*a* on the floor 16*a*. Construction workers will then pull the concrete floor form 10*a* in through the opening 58 and release the cable 22 from the concrete floor form 10*a*. The concrete floor form 10*a* is adjusted on the floor 16*a* and raised to the level of the anchoring structure 38 to complete build of the concrete floor form for the upper floor 16*b*. Rebar is placed and uncured concrete is poured within the concrete floor form to form the upper floor 16*b*. After formation and curing of the concrete of the upper floor 16*b*, the concrete floor form 10*a* is then lowered and must now be withdrawn or extracted through the opening 58. To this end, the crane cable roller assembly 36 may be attached to the anchoring structure 38 of the upper floor 16*b*, as shown in FIG. 2. The back plate 42 of the crane cable roller assembly 36 may be bolted to the anchoring structure 38. The cable 22 is received on roller 28 between guide plates 48.

When the crane cable roller assembly 36 is mounted to the anchoring structure 38, the roller 28 may extend beyond a lower surface 62 of the upper floor 16*b*, as shown in FIG. 3. The reason is to prevent contact of the cable 22 to the lower surface 62 of the upper floor 16*b* as the object 10 or the concrete floor form 10*a* is pulled toward the outer peripheral area 14 of the lower floor 16*a*. Preferably, the roller 28 may have a 2" diameter. An exterior surface of the roller 28 may extend 1" below the lower surface 62 of the upper floor 16*b*. Other positions are also contemplated. By way of example and not limitation, the lowest point of the roller's exterior surface may be level with the lower surface 62 of the upper floor 16*b* or immediately adjacent but slightly above the lower surface 62 of the upper floor 16*b* so long as the cable 22 of the crane 20 clears the lower surface 62 of the upper floor 16*b* when the object 10 or concrete floor form 10*a* is being pulled across the floor 16*a*.

Safe crane operation dictates that the cable 22 be used to only provide vertical lift or lowering of the object 10 or the concrete floor form 10*a*. The boom 26 of the crane 20 may not be swung in a manner to pull the object 10 from the interior area 12 toward the outer peripheral area 14. The roller 28 permits the boom 26 to remain stationary and convert the vertical movement of the cable 22 into a horizontal component to drag the object 10 or the concrete floor form 10*a* toward the outer peripheral area 14. More particularly, after the crane cable roller assembly 36 is attached to an anchoring structure 38, the boom 26 of the crane 20 is adjusted such that the cable 20 is in front of the roller 28 of the crane cable roller assembly 36. The crane cable 22 may hang vertically straight down. The construction worker may take hold of the distal end of the cable 22 and attach the distal end of the cable 22 to the object 10 or the concrete floor form 10*a* through means that are known in the art or developed in the future. This is shown in FIG. 2. After the distal end of the cable 22 is attached to the object 10 or the concrete floor form 10*a*, the crane operator lifts the cable 22 in the direction of arrow 24 which pulls the cable 22 taut between the boom 26 and the object 10 or the concrete floor form 10*a*. As the cable 22 is lifted, the cable 22 presses against the roller 28. A portion of the cable 22 below the roller 28 is traversed in direction of arrow 30 shown in FIG. 2. The cable 22 provides a horizontal component which pulls the object 10 or the concrete floor form 10*a* in the direction of arrow 32. When the concrete floor form 10*a* is sufficiently close to the edge surface 34*a* of the floor 16*a*, the distal end of the cable 22 is detached from the concrete floor form 10*a* and reattached to the concrete floor form 10*a* so that the cable 22 can vertically lift the concrete floor form 10*a*. The cable 22 of the crane 20 is readjusted to the object's center of gravity. Once the concrete floor form 10*a* is extracted out of the aperture 58 (see FIG. 7), the concrete floor form 10*a* is hoisted up and placed on the newly created floor 16*b*. The process is repeated until all of the floors 16 of the multistory building 18 are formed.

The above description is given by way of example, and not limitation. Given the above disclosure, one skilled in the art could devise variations that are within the scope and spirit of the invention disclosed herein, including various ways of attaching the cable to the object 10. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of pulling an object from an interior area of a lower floor to an outer peripheral area of the lower floor of an unfinished multi story building, the method comprising the steps of:

attaching a crane cable roller assembly to an outer periphery of an upper floor;

attaching a distal end portion of a cable of a crane to the object located at the interior area of the lower floor;

aligning the cable to a roller of the crane cable roller assembly;

vertically lifting the cable of the crane;

urging the cable against the roller of the crane cable roller assembly; and converting the vertical lift of the cable of the crane into a horizontal pull component to pull the object located at the interior area of the lower floor to the outer peripheral area of the lower floor.

2. The method of claim 1 wherein the attaching the crane cable roller assembly step comprises the step of aligning said of the crane cable roller assembly to a lower edge of the upper floor and mounting the crane cable roller assembly to the outer periphery of the upper floor.

3. The building of claim 1 wherein the attaching the crane cable roller assembly step comprises the step of aligning said roller of the crane cable roller assembly closer to a lower edge of the upper floor than an upper edge of the upper floor and mounting the crane cable roller assembly to the outer periphery of the upper floor.

4. The method of claim 1 further comprising the step of moving the cable of the crane in front of the roller of the crane cable roller assembly.

5. The method of claim 1 comprising the step of continuing to lift the cable of the crane until the object is traversed to the outer peripheral area.

6. The method of claim 1 further comprising the step of guiding the cable of the crane between side guides of the crane cable roller assembly to maintain the cable of the crane on the roller during the lifting step.

7. The method of claim 1 wherein the attaching the crane cable roller assembly step comprises the step of aligning a rotating axis of the roller of the crane cable roller assembly generally parallel to the outer periphery of the upper floor and mounting the crane cable roller assembly to the outer periphery of the upper floor.

8. The method of claim 1 wherein the attaching the crane cable roller assembly step comprises the step of aligning a lower side of the roller so as to be at a lower elevation compared to the lower surface of the upper floor and mounting the crane cable roller assembly to the outer periphery of the upper floor.

9. The method of claim 1 wherein the attaching the crane cable roller assembly step comprises the step of aligning a lower side of the roller so as to be slightly above a lower surface of the upper floor so long as the cable of the crane does not inadvertently contact the lower surface of the upper floor as the object is pulled toward the outer peripheral area of the lower floor and mounting the crane cable roller assembly to the outer periphery of the upper floor.

10. The method of claim 1 wherein the attaching the crane cable roller assembly step comprises the step of aligning a rotating axis of the roller so as to be horizontally aligned to the lower edge of the upper floor and mounting the crane cable roller assembly to the outer periphery of the upper floor.

11. The method of claim 1 wherein the attaching the crane cable roller assembly step comprises the step of aligning the roller so as to be horizontally offset away from the outer periphery of the upper floor and mounting the crane cable roller assembly to the outer periphery of the upper floor.

* * * * *